US009125531B2

(12) United States Patent
Forrest

(10) Patent No.: US 9,125,531 B2
(45) Date of Patent: Sep. 8, 2015

(54) SEALING ARRANGEMENT FOR BATH BAR

(75) Inventor: Earl David Forrest, Asheboro, NC (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 2334 days.

(21) Appl. No.: 12/032,844

(22) Filed: Feb. 18, 2008

(65) Prior Publication Data

US 2009/0205126 A1 Aug. 20, 2009

(51) Int. Cl.

| | |
|---|---|
| ***A47K 3/024*** | (2006.01) |
| ***A47K 17/02*** | (2006.01) |
| ***A47K 3/00*** | (2006.01) |

(52) U.S. Cl.

CPC ..... *A47K 17/022* (2013.01); *A47K 3/003* (2013.01); *A47K 2201/02* (2013.01)

(58) Field of Classification Search

USPC ..... 248/309.1, 251, 314; 4/576.1, 571.1, 4/611, 592, 573.1, 559; 16/110.1, 412, 16/436; 256/69, 65.16, 59

See application file for complete search history.

(56) References Cited

U.S. PATENT DOCUMENTS

| | | | | | |
|---|---|---|---|---|---|
| 4,193,586 | A * | 3/1980 | Guenther | 256/69 |
| 4,887,323 | A * | 12/1989 | DiVito et al. | 4/577.1 |
| 5,026,013 | A * | 6/1991 | Robbins | 248/221.12 |
| 5,050,252 | A * | 9/1991 | Cuttriss | 4/576.1 |
| 5,297,010 | A * | 3/1994 | Camarota et al. | 362/501 |
| 5,765,812 | A * | 6/1998 | Guenther | 256/69 |
| 6,932,329 | B1 * | 8/2005 | Harder | 256/67 |
| 2003/0110716 | A1 * | 6/2003 | Hansen | 52/184 |

FOREIGN PATENT DOCUMENTS

GB 2224459 A * 5/1990

* cited by examiner

*Primary Examiner* — Lauren Crane

(74) *Attorney, Agent, or Firm* — Carlson, Gaskey & Olds, PC

(57) ABSTRACT

A grab bar is disclosed for use in a bathing area. The grab bar includes a longitudinal bar extending to a leg that includes a base configured to be secured to a wall. The leg includes a hole, and a fastener is receive in the hole and extends through the base to the wall. A seal is supported by the base and surrounds the hole to seal the grab bar relative to the wall. An insert is arranged in the hole for reinforcement and is in an interference relationship to the leg to provide a seal there with. A flexible washer is arranged between the fastener and the insert or leg to seal a head of the washer relative to the leg.

8 Claims, 1 Drawing Sheet

SEALING ARRANGEMENT FOR BATH BAR

BACKGROUND

This disclosure relates to an arrangement for sealing a plastic bath bar or grab bar relative to a wall in a bathing area, such as a shower enclosure or near a bath tub.

Grab bars are used in bathing areas, such as showers, to provide a stable structure for a person to grasp. Typically, the grab bar is secured to a wall that is exposed to moisture or running water. The grab bar includes one or more legs that are secured to the wall using multiple fasteners. The walls typically are not impervious to moisture such that they become damaged when exposed to water. The fasteners that secure the grab bar to the wall create areas that are susceptible to water penetration. For example, water often flows into the wall past the heads of the fasteners or behind the legs where they meet the wall.

What is needed is a sealing arrangement the prevents water from flowing into the wall.

SUMMARY

A grab bar is disclosed for use in a bathing area. The grab bar includes a longitudinal bar extending to a leg that includes a base configured to be secured to a wall. The leg includes a hole, and a fastener is receive in the hole and extends through the base to the wall. A seal is supported by the base and surrounds the hole to seal the grab bar relative to the wall. An insert is arranged in the hole for reinforcement and is in an interference relationship to the leg to provide a seal there with. A flexible washer is arranged between the fastener and the insert or leg to seal a head of the washer relative to the leg.

These and other features of the disclosure can be best understood from the following specification and drawings, the following of which is a brief description.

DETAILED DESCRIPTION

Figure 1:
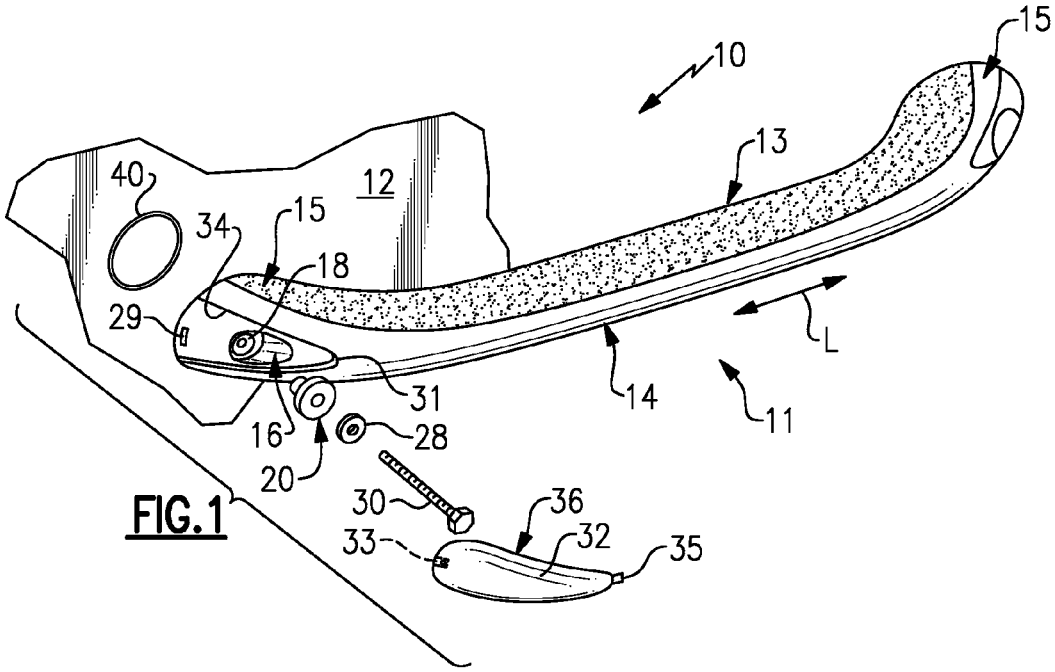
FIG. 1 is an exploded perspective view of an example grab bar assembly.

A grab bar assembly 10 is shown in FIG. 1. The assembly 10 includes opposing front and rear sides 11, 13. The assembly 10 includes a bar 14 having opposing legs 15 that extend from the front side 11 to the rear side 13. The bar 14 extends along a longitudinal direction L. The bar 14 and legs 15 are molded as a single, unitary member that is formed by a molding process, such as gas-assisted injection molding. In one example, the bar 14 is constructed from a plastic material, such as polypropylene, having an approximately 30% glass filler. Polypropylene has good chemical resistance to bathroom spray cleaners, for example. The legs 15 are secured to a wall 12 by fastening elements 30, such as ¼ inch lag screws, best shown in FIG. 3.

Figure 2:
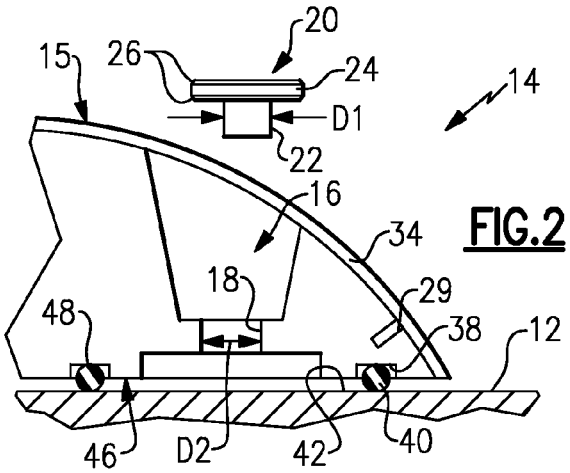
FIG. 2 is a cross-sectional view of a leg of the grab bar.
Figure 3:
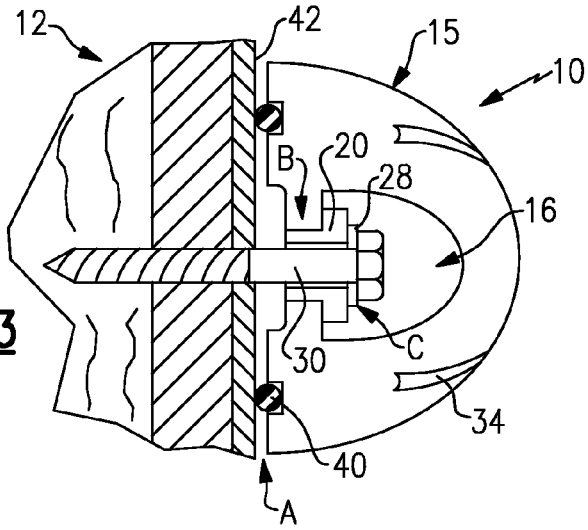
FIG. 3 is a cross-section view of the grab bar secured to a wall.

In the example, each leg 15 includes a cavity 16 that has a hole 18 for receiving the fastening element 30. In one example, an insert 20 is disposed within the cavity 16 and aligned with the hole 18 to reinforce the legs 15 so that the area does not crack the plastic grab bar during installation or use, thus, weakening the bar 14. Referring to FIG. 2, the insert 20 includes a body 22 having a diameter D1. A flange 24 extends radially outwardly from the body 22 and acts as a washer against which a head of the fastening element 30 abuts during installation. In one example, the hole 18 includes a diameter D2 that is smaller than the diameter D1. The insert 20 can be separately installed into the hole 18 in an interference fit in one example, or the bar 14 can be molded about the insert 20 when it is formed. This provides a water-tight seal between the insert 20 and leg 15 in area B (FIG. 3). In one example, the insert 20 is constructed from a brass material. The insert 20 includes chamfered edges 26 to prevent stress risers and cracking of the leg 15 during installation as the fastening element 30 is screwed into the wall 12.

A resilient washer 28 is provided between the fastening element 30 and the insert 20 to provide a seal in area C. In one example, the resilient washer 28 can be constructed from a nylon material.

The cavity 16 includes an edge 34. An aesthetic cover 32 is installed over the cavity 16 to enclose the fastening element 30 and provide an aesthetically pleasing appearance. The cover 32 includes a perimeter 36 that locates the cover 32 relative to the bar 14 with the perimeter 36 in abutting relationship the edge 34. In the example shown, the bar 14 includes first and second slots 29, 31. The cover 32 includes first and second tabs 33, 35 that are respectively received by the first and second slots 29, 31. In the disclosed example, the cover 32 is generally flush with the exterior surface of the front side 11 of the bar 14.

Each of the legs 15 includes a generally planar base 46 or surface having an annular recess 38. A seal 40, such as an o-ring, is received by the recess 38. The seal 40 can have a circular, quadrangular or other cross-sectional shape. An adhesive 48 can be used to securely retain the seal 40 within the recess 38. The seal 40 surrounds the hole 18 to prevent water from migrating past the seal 40 at surface 42 (FIGS. 2 and 3) into the wall 12 in area A.

The bar 14 can be assembled with the seal 40 and insert 20 retained relative to the bar 14. A single fastening element 30 is used to secure each leg 15 of the bar 14 to the wall 12 in the example. A flexible washer 28 is used between the head of the fastening element 30 and the insert 20. The cover 32 is arranged over the cavity 16 to complete assembly of the bar 14.

Although example embodiments have been disclosed, a worker of ordinary skill in this art would recognize that certain modifications would come within the scope of the claims. For that reason, the following claims should be studied to determine their true scope and content.

What is claimed is:

1. A grab bar for use in a bathing area comprising:

a longitudinal bar extending to a leg, said leg including a base configured to be secured to a wall, said leg having a cavity in proximity to said base and a hole extending through said base and communicating with said cavity;

a fastener having a portion disposed in said cavity and a portion extending through said hole in said base;

a seal supported by said base and surrounding said hole; and an insert received within said hole in an interference relationship therein and providing a seal between said leg and said insert within said hole, said fastener extending through said insert, and wherein the leg is plastic and the insert is metallic.

2. A grab bar for use in a bathing area comprising:

a longitudinal bar extending to a leg, said leg including a base configured to be secured to a wall, said leg having a cavity in proximity to said base and a hole extending through said base and communicating with said cavity;

a fastener having a portion disposed in said cavity and a portion extending through said hole in said base;

a seal supported by said base and surrounding said hole; and an insert received within said hole in an interference relationship therein and providing a seal between said leg and said insert within said hole, said fastener extending through said insert, and wherein the insert is metallic and includes a body disposed in the hole and a flange extending from the body, the flange arranged beneath a head of the fastener.

3. The grab bar according to claim 2, comprising a flexible washer arranged between the head and the flange, the fastener extending through the washer, the washer in abutment with the fastener and the insert to provide a seal there between.

4. The grab bar according to claim 2, wherein the leg includes a cavity exposing the head, and comprising a cover secured to the leg and enclosing the cavity and the head.

5. A grab bar for use in a bathing area comprising:

a longitudinal bar extending to a leg, said leg including a base configured to be secured to a wall, said leg having a cavity in proximity to said base and a hole extending through said base and communicating with said cavity;

a fastener having a portion disposed in said cavity and a portion extending through said hole in said base;

a seal supported by said base and surrounding said hole;

an insert received within said hole in an interference relationship therein and providing a seal between said leg and said insert within said hole, said fastener extending through said insert; and a flexible washer arranged between a head of the fastener and the insert, the fastener extending through the washer, the washer in abutment with the fastener and the insert to provide a seal there between.

6. The grab bar according to claim 5, wherein the base includes a recess around the hole, and the seal is disposed in the recess.

7. The grab bar according to claim 6, wherein the seal is an elastomeric o-ring.

8. The grab bar according to claim 6, comprising an adhesive securing the seal within the recess.

* * * * *